US010507854B2

(12) United States Patent
DeJarnatt et al.

(10) Patent No.: US 10,507,854 B2
(45) Date of Patent: Dec. 17, 2019

(54) RAILROAD CROSSING INDICATION DEVICE, RAILROAD CROSSING INDICATION SYSTEM, AND METHOD FOR DISPLAYING INFORMATION AT RAILROAD CROSSINGS

(71) Applicant: Siemens Industry, Inc., Alpharetta, GA (US)

(72) Inventors: Barton DeJarnatt, Louisville, KY (US); Travis Pless, Port St Lucie, FL (US)

(73) Assignee: SIEMENS MOBILITY, INC., New York, NY (US)

( * ) Notice: Subject to any disclaimer, the term of this patent is extended or adjusted under 35 U.S.C. 154(b) by 66 days.

(21) Appl. No.: 15/749,551

(22) PCT Filed: Aug. 31, 2015

(86) PCT No.: PCT/US2015/047656
§ 371 (c)(1),
(2) Date: Feb. 1, 2018

(87) PCT Pub. No.: WO2017/039597
PCT Pub. Date: Mar. 9, 2017

(65) Prior Publication Data

US 2018/0222507 A1 Aug. 9, 2018

(51) Int. Cl.
*B61L 29/32* (2006.01)
*B61L 29/28* (2006.01)
(Continued)

(52) U.S. Cl.
CPC ..... *B61L 29/32* (2013.01); *B61L 29/286* (2013.01); *B61L 29/30* (2013.01); *B61L 23/007* (2013.01)

(58) Field of Classification Search
CPC ..... B61L 29/24; B61L 29/243; B61L 29/246; B61L 29/28; B61L 29/30; B61L 29/32; B61L 29/286
See application file for complete search history.

(56) References Cited

U.S. PATENT DOCUMENTS 5,864,304 A * 1/1999 Gerszberg ..... B61L 29/18 246/122 R
6,836,221 B1 * 12/2004 Boddie ..... B61L 29/246 246/125

(Continued)

FOREIGN PATENT DOCUMENTS

EP 2330011 A1 6/2011
JP H0858589 A 3/1996

(Continued)

OTHER PUBLICATIONS

PCT International Search Report and Written Opinion of International Searching Authority dated Apr. 29, 2016 corresponding to PCT International Application No. PCT/US2015/047656 filed Aug. 31, 2015.

(Continued)

*Primary Examiner* — Jason C Smith

(57) ABSTRACT

A railroad crossing indication device (250) includes a processing unit (350) for receiving and processing data provided by a constant warning time device (40) in communication with a railroad track (20), wherein the data relate to a train approaching the railroad crossing, and a screen unit (300, 400, 500) for displaying information of the train approaching the railroad crossing based upon the data provided by the constant warning time device (40). Furthermore, a railroad crossing indication system (200) and a method (600) for displaying information at railroad crossings are disclosed.

11 Claims, 4 Drawing Sheets

(51) Int. Cl.
*B61L 29/30* (2006.01)
*B61L 23/00* (2006.01)

(56) References Cited

U.S. PATENT DOCUMENTS 8,054,197 B1 * 11/2011 Martin ..... B61L 25/021 246/125
8,469,319 B2 * 6/2013 Kiss, Jr. ..... B61L 29/284 246/125
8,909,396 B2 * 12/2014 Hilleary ..... B61L 27/00 340/910
9,079,494 B2 * 7/2015 Skelton ..... B60K 28/063
9,701,328 B2 * 7/2017 Martin ..... B61L 29/28
9,844,059 B2 * 12/2017 Park ..... H04L 1/00
9,873,442 B2 * 1/2018 Costa ..... H04N 5/23203
9,875,414 B2 * 1/2018 Naithani ..... G06K 9/00798
9,919,723 B2 * 3/2018 Bhagwatkar ..... B64C 39/024
10,049,298 B2 * 8/2018 Kraeling ..... G06K 9/00791
10,110,795 B2 * 10/2018 Kraeling ..... H04N 5/23203
2008/0169939 A1 * 7/2008 Dickens ..... B61L 29/226 340/910
2017/0217463 A1 * 8/2017 DeJarnatt ..... B61L 15/0027
2018/0222507 A1 * 8/2018 DeJarnatt ..... B61L 29/24

FOREIGN PATENT DOCUMENTS

WO 2000003906 A1 1/2000
WO 2011106834 A1 9/2011

OTHER PUBLICATIONS

"Web Application Progress Bar"; ip.com Journal, ip.com Inc.; West Henrietta, NY, US, Nov. 17, 2006; XP013116835; ISSN: 1533-0001; pp. 1-2.

* cited by examiner

RAILROAD CROSSING INDICATION DEVICE, RAILROAD CROSSING INDICATION SYSTEM, AND METHOD FOR DISPLAYING INFORMATION AT RAILROAD CROSSINGS

CROSS REFERENCE TO RELATED APPLICATIONS

This application is the U.S. National Stage of International Application No. PCT/US2015/047656 filed 31 Aug. 2015 and claims benefit thereof, the entire content of which is hereby incorporated herein by reference.

BACKGROUND

1. Field

Aspects of the present invention generally relate to a railroad crossing indication device, a railroad crossing indication system and a method for displaying information at railroad crossings.

2. Description of the Related Art

A constant warning time device, also referred to as a grade crossing predictor (GCP) in the U.S. or a level crossing predictor in the U.K., is an electronic device that is connected to the rails of a railroad track and is configured to detect the presence of an approaching train and determine its speed and distance from a crossing, i.e., a location at which the tracks cross a road, sidewalk or other surface used by moving objects. The constant warning time device will use this information to generate a constant warning time signal for controlling a crossing warning device. A crossing warning device is a device that warns of the approach of a train at a crossing, examples of which include crossing gate arms (e.g., the familiar black and white striped wooden arms often found at highway grade crossings to warn motorists of an approaching train), crossing lights (such as the red flashing lights often found at highway grade crossings in conjunction with the crossing gate arms discussed above), and/or crossing bells or other audio alarm devices. Constant warning time devices are often, but not always, configured to activate the crossing warning device at a fixed time, e.g., 30 seconds, prior to an approaching train arriving at a crossing.

Motorists have always had waiting/patience problems with railroad crossings. They ignore the lights, try to circumvent the crossing gates, and get frustrated while waiting for a train to pass. Sometimes, motorists and pedestrians ignore the warning signs because they cannot see the train coming, don't think there is danger present, or are too impatient to wait. Some motorists underestimate the danger associated with railroad crossings and how circumventing safety systems can have seriously negative consequences. There are also several examples of motorists driving through crossing gates and striking the side of a moving train. Thus, there exists a need to convey additional information at railroad crossings so that motorists will be deterred from circumventing the provided safety systems.

SUMMARY

Briefly described, aspects of the present invention relate to railroad crossing indication device, a railroad crossing indication system, and a method for displaying information at railroad crossings. The term 'railroad crossing' is also known and herein referred to as 'railroad grade crossing' or 'grade crossing'.

A first aspect of the present invention provides a railroad crossing indication device comprising a processing unit configured to receive and process data provided by a constant warning time device in communication with a railroad track, wherein the data relate to a train approaching a railroad track, and a screen unit configured to display information of the train approaching the railroad crossing based upon the data provided by the constant warning time device.

A second aspect of the present invention provides a railroad crossing indication system comprising a constant warning time device in communication with a railroad track, at least one railroad crossing warning device located at a railroad crossing in communication with the constant warning time device, and a railroad crossing indication device located in proximity to the railroad crossing and the at least one railroad crossing warning device, and in communication with the constant warning time device, wherein the railroad crossing indication device displays information relating to a train approaching the railroad crossing based upon data of the train approaching the railroad crossing provided by the constant warning time device.

A third aspect of the present invention provides a method for displaying information at a railroad crossing comprising providing data by a constant warning time device which is in communication with a railroad track, the data relating to a train approaching a railroad crossing, receiving the data by a railroad crossing indication device located in proximity to the railroad crossing and operably coupled to the constant warning time device, and displaying, by a screen unit of the railroad crossing indication device, information of the train approaching the railroad crossing using the data provided by the constant warning time device.

DETAILED DESCRIPTION

To facilitate an understanding of embodiments, principles, and features of the present invention, they are explained hereinafter with reference to implementation in illustrative embodiments. In particular, they are described in the context of being a railroad crossing indication device, a railroad crossing indication system, and method for displaying information at railroad crossings, in particular in connection with constant warning time devices, also referred to as grade crossing predictor (GCP) or grade crossing predictor system (GCP system). Embodiments of the present invention, however, are not limited to use in the described devices or methods.

The components and materials described hereinafter as making up the various embodiments are intended to be illustrative and not restrictive. Many suitable components and materials that would perform the same or a similar function as the materials described herein are intended to be embraced within the scope of embodiments of the present invention.

Typical constant warning time devices include a transmitter that transmits a signal over a circuit formed by the track's rails and one or more termination shunts positioned at desired approach distances from the transmitter, a receiver that detects one or more resulting signal characteristics, and a logic circuit such as a microprocessor or hardwired logic that detects the presence of a train and determines its speed and distance from the crossing. The approach distance depends on the maximum allowable speed of a train, the desired warning time, and a safety factor. Preferred embodiments of constant warning time devices generate and transmit a constant current AC signal on said track circuit; constant warning time devices detect a train and determine its distance and speed by measuring impedance changes caused by the train's wheels and axles acting as a shunt across the rails, which effectively shortens the length, and hence lowers the impedance, of the rails in the circuit. Multiple constant warning devices can monitor a given track circuit if each device measures track impedance at a different frequency.

Figure 1:
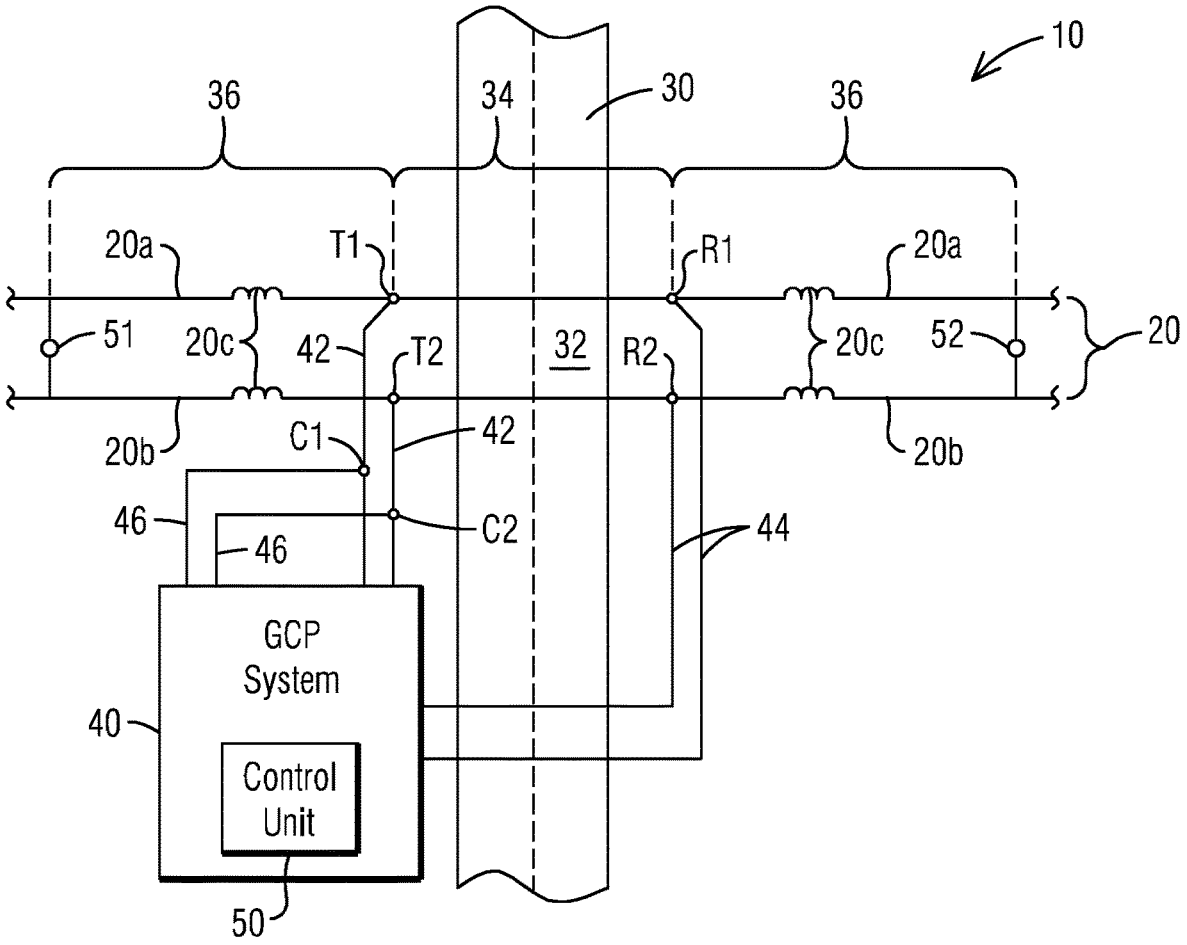
FIG 1 PRIOR ART
FIG. 1 illustrates an example track system constructed in accordance with an embodiment disclosed herein.

FIG. 1 illustrates a known railroad track system 10 in accordance with a disclosed embodiment. The railroad track system 10 is provided at a location in which a road 30 crosses a railroad track 20. The crossing of the road 30 and the railroad track 20 forms an island 32.

The railroad track 20 includes two rails 20*a*, 20*b* and a plurality of ties (not shown in FIG. 1) that are provided over and within railroad ballast (not shown in FIG. 1) to support the rails 20*a*, 20*b*. The rails 20*a*, 20*b* are shown as including inductors 20*c*. The inductors 20*c*, however, are not separate physical devices but rather are shown to illustrate the inherent distributed inductance of the rails 20*a*, 20*b*.

The system 10 includes a constant warning time device 40, also referred to as GCP or GCP system that comprises a transmitter that connects to the rails 20*a*, 20*b* at transmitter connection points T1, T2 on one side of the road 30 via transmitter wires 42. The constant warning time device 40 also comprises a main receiver that connects to the rails 20*a*, 20*b* at main receiver connection points R1, R2 on the other side of the road 30 via receiver wires 44. The receiver wires 44 are also referred to as main channel receiver wires. The constant warning time device 40 further comprises a check receiver that connects to the rails 20*a*, 20*b* at check receiver connection points C1, C2 via check channel receiver wires 46. The check channel receiver wires 46 are connected to the track 20 on the same side of the road 30 as the transmitter wires 42, resulting in a six-wire system. The main channel receiver and check channel receiver operate in much the same manner with an incoming train move, providing a parallel check of the main channel operation. Those of skill in the art will recognize that the transmitter and receivers (main channel receiver and check channel receiver), other than the physical conductors that connect to the track 20, are often co-located in an enclosure located on one side of the road 30. The constant warning time device 40 includes a control unit 50 connected to the transmitter and receivers. The control unit includes logic, which may be implemented in hardware, software, or a combination thereof, for calculating train speed, distance and direction, and producing constant warning time signals for the crossing.

Also shown in FIG. 1 is a pair of termination shunts S1, S2, one on each side of the road 30 at a desired distance from the center of the island 32, e.g., 3000 feet. It should be appreciated that FIG. 1 is not drawn to scale and that both shunts S1, S2 are approximately the same distance away from the center of the island 32. The termination shunts S1, S2 can be embodied for example as narrow band shunts (NBS). FIG. 1 further illustrates an island circuit 34 which is the area between transmitter connection points T1, T2 and main receiver connection points R1, R2. For example, the constant warning time device 40 monitors the island circuit 34 as well as approach circuits 36 which lie to the right and left of the island circuit 34, i.e., between the island circuit 34 and the termination shunts S1, S2.

Typically, the shunts S1, S2 positioned on both sides of the road 30 and the associated constant warning time device 40 are tuned to the same frequency. This way, the transmitter can continuously transmit one AC signal having one frequency, the receiver can measure the voltage response of the rails 20*a*, 20*b* and the control unit 50 can make impedance and constant warning time determinations based on the one specific frequency. When a train crosses one of the termination shunts S1, S2, the train's wheels and axles act as shunts, which lowers the inductance, impedance and voltage measured by the corresponding control unit 50. Measuring the change in the impedance indicates the distance of the train, and measuring the rate of change of the impedance (or integrating the impedance over time) allows the speed of the train to be determined.

Figure 2:
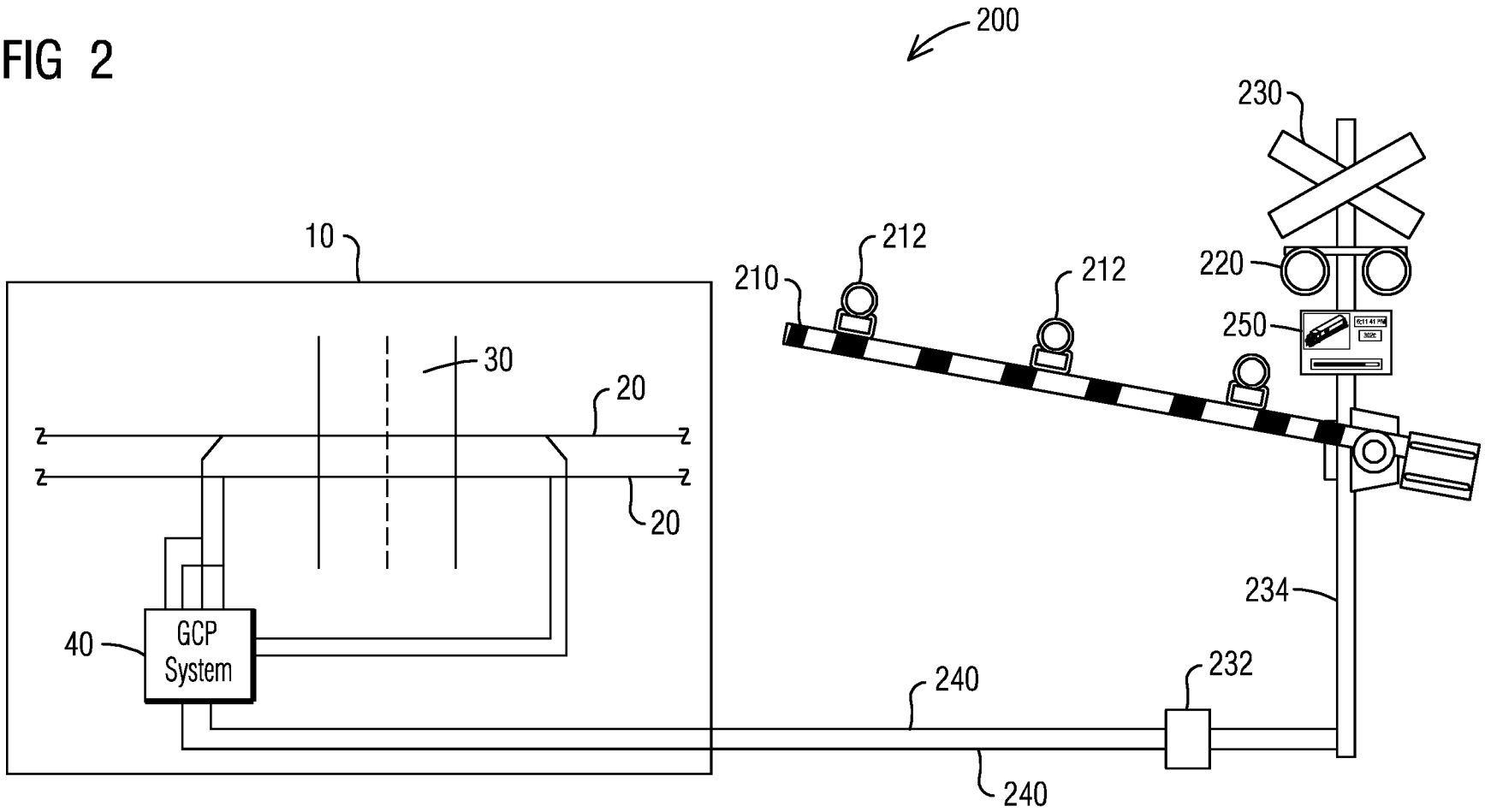
FIG. 2 illustrates an example railroad crossing indication system in accordance with an exemplary embodiment of the present invention disclosed herein.

FIG. 2 illustrates an example railroad crossing indication system 200 in accordance with an exemplary embodiment of the present invention disclosed herein. FIG. 2 illustrates a railroad track system 10 as described for example in FIG. 1, wherein only the railroad track 20, the road 30, and the GCP system 40 are labeled within FIG. 2.

FIG. 2 shows one or more railroad crossing warning devices, also referred to as grade crossing warning devices, which warn of the approach of a train at the crossing of the road 30 and the railroad track 20, i.e., a railroad crossing. The railroad crossing warning devices include for example a crossing gate arm 210 with (or without) gate arm lights 212 spaced along the arm 210, crossing lights 220, a railroad crossbuck 230, and/or other devices not illustrated herein, as for example crossing bells or other audio alarm devices. The crossing warning devices are in communication with the GCP system 40 of the system 10 via connecting elements 240, which are for example electric cables. It should be noted that the components of FIG. 2 are illustrated schematically and are not drawn to scale, in particular are not drawn to scale in relation to each other.

As described before, the GCP system 40 is configured to detect the presence of an approaching train, determine its speed and distance from the railroad crossing, calculates when the train will arrive at the crossing, and will use this information to generate constant warning time signals for controlling the crossing warning devices 210, 212, 220, 230. Typically, a normally energized master relay 232, only shown schematically herein, is arranged between the GCP system 40 and the warning devices 210, 212, 220, 230, for example along the connecting elements 240 and operably coupled by the connecting elements 240, wherein an output of the GCP system 40 feeds a coil of the master relay 232. According to a pre-programmed time, for example a number of seconds and/or minutes, before projected arrival time of the approaching train, the GCP system 40 is configured such that the output feeding the coil of the master relay 232 is turned off to drop the master relay 232 and to activate the crossing warning devices 210, 212, 220, 230. It should be noted that the GCP system 40, the master relay 232 and the warning time devices 210, 212, 220, 230 will not be described in further detail as those of ordinary skill in the art are familiar with these devices and systems.

In accordance with an exemplary embodiment, the railroad crossing indication system 200 further comprises a railroad crossing indication device 250, also referred to as indication device 250 herein. As described before, motorists have always had waiting/patience problems with railroad crossings. They ignore the lights, try to circumvent the crossing gates, and get frustrated while waiting for a train to pass. The indication device 250 conveys additional information at the railroad crossing so that motorists will be deterred from circumventing the provided safety systems, which are for example the warning devices 210, 212, 220, 230. In an embodiment, the indication device 250 is mounted to a support 234 of at least one of the warning devices 210, 212, 220, 230. Alternatively, the indication device 250 can be mounted to a separate support in proximity to the railroad crossing, such as for example a separate post or any other suitable support base provided in a way that motorist can easily see the indication device 250 while waiting for a train to pass.

Figure 3:
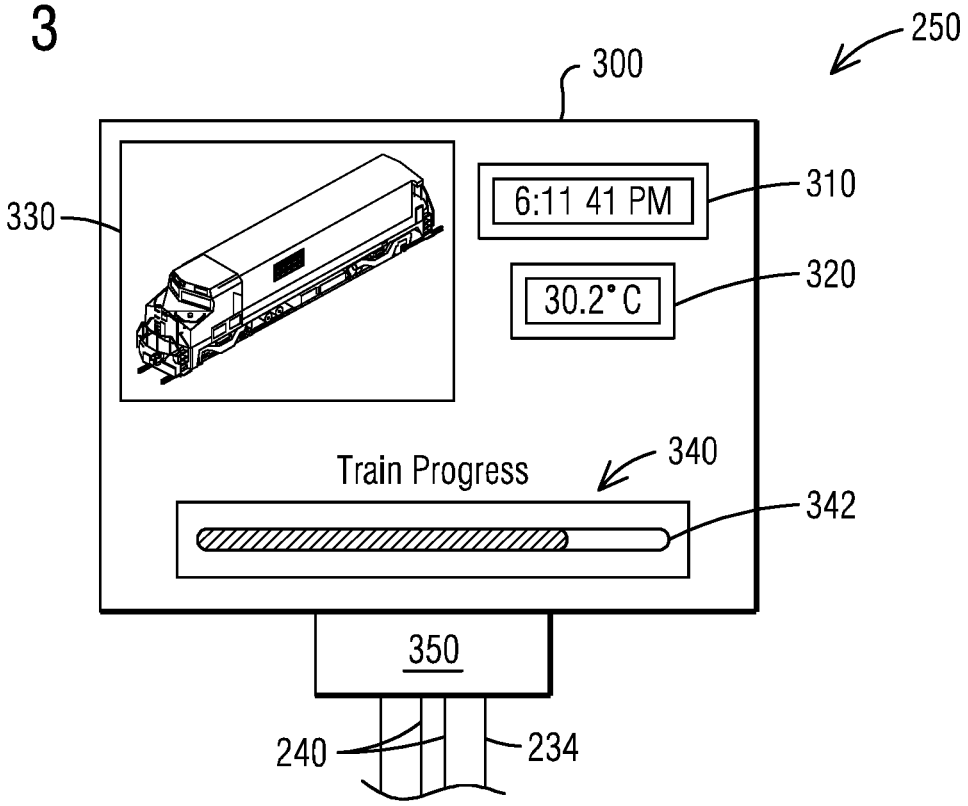
FIG. 3 illustrates an embodiment of a railroad crossing indication device in accordance with an exemplary embodiment of the present invention.

FIG. 3 illustrates an embodiment of a railroad crossing indication device 250 in accordance with an exemplary embodiment of the present invention. The railroad crossing indication device 250 comprises a processing unit 350 configured to receive and process data provided by the constant warning time device 40, for example via the connecting elements 240 (see also FIG. 2). The indication device 250 comprises a screen unit 300 configured to display information of the train approaching the railroad crossing based upon the data provided by the constant warning time device 40. As described before, the GCP system 40 detects the presence of an approaching train, determines its speed and distance from the railroad crossing, and calculates when the train will arrive at the crossing. This data is now transmitted to the indication device 250, wherein the processing unit 350 receives and processes these data, i.e., uses these data to convey additional information about the approaching train, as for example train speed, direction of the train, proximity of the train, time of arrival of the train at the railroad crossing, time the train takes to pass the railroad crossing (how long does it take for the train to pass the railroad crossing after arriving at the railroad crossing, for example in combination with a countdown timer or progression bar counting down the minutes and/or seconds until the train has passed the railroad crossing) etc. to the waiting motorists. This way, the indication device 250 uses data that are already being provided by the GCP system 40 to display relevant safety, warning, and convenience information. The processing unit 350 of the indication device 250 is illustrated as separate unit, but can also be integrated into the indication device 250. The processing unit 350 is configured to receive the data from the GCP system 40 and to process the data. Processing can mean that the data are at least read and simply forwarded to the screen unit 300 for display. Processing can also mean that the data are at least read, interpreted and that associated/corresponding information is selected and/or provided for display on the screen unit 300. Processing can also mean that the received data from the GCP system 40 are transformed into a different format. For example, the data received by the indication device 250 includes that the approaching train will arrive at the railroad crossing in 3 minutes. The processing unit 350 receives the data and can select and provide for example a corresponding countdown timer counting down in seconds and/or minutes to the arrival of the train at the crossing. Thus, the processing unit 350 includes logic, which may be implemented in hardware, software, or a combination thereof. One of ordinary skill in the art can contemplate many other ways, formats and templates in which the data of the GCP system 40 are displayed on the screen unit 300 of the indication device 250.

The screen unit 300, also referred to herein as display or simply screen, can comprises multiple screen sections, for example sections 310, 320, 330 displaying different elements or features, such as for example current time in section 310, current temperature in section 320 and a picture of an approaching train in section 330. The screen 300 can further comprise section 340 illustrating a graphical element visualizing progression of an approaching train. In FIG. 3, the graphical element is a progress bar 342 or progress indicator. Other types of elements showing progression of an approaching train can be used, for example a countdown clock or countdown timer counting down in seconds and/or minutes to the arrival of a train at the railroad crossing. One of ordinary skill understands that many other elements can be displayed on the indication screen 300 as well as that the different elements illustrated in the multiple sections 310, 320, 330 can be in colour, black and white, or a combination thereof. For example, many different graphical elements, elements to be displayed, patterns, templates, etc. can be stored within the indication device 250, for example in a memory unit integrated into the indication device 250, wherein the processing unit 350 can be configured such that specific patterns or elements are selected according to specific received data from the GCP system 40.

Figure 4:
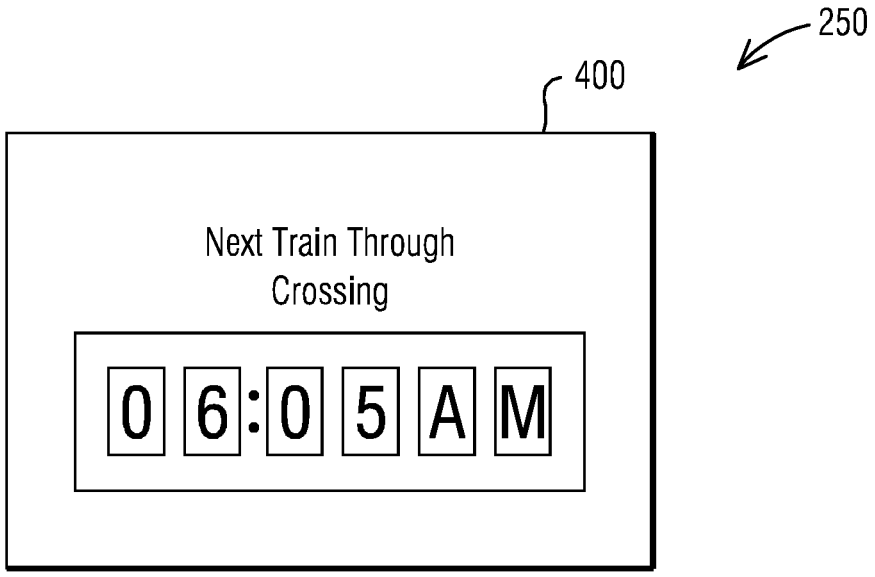
FIG. 4 illustrates a further embodiment of a railroad crossing indication device in accordance with an exemplary embodiment of the present invention.

FIG. 4 illustrates a further embodiment of a railroad crossing indication screen unit 400 of a railroad crossing indication device 250. The example screen 400 displays the time when a next train passes through the railroad crossing. According to the example of FIG. 4, the next train passes through the crossing at 06:05 am.

Figure 5:
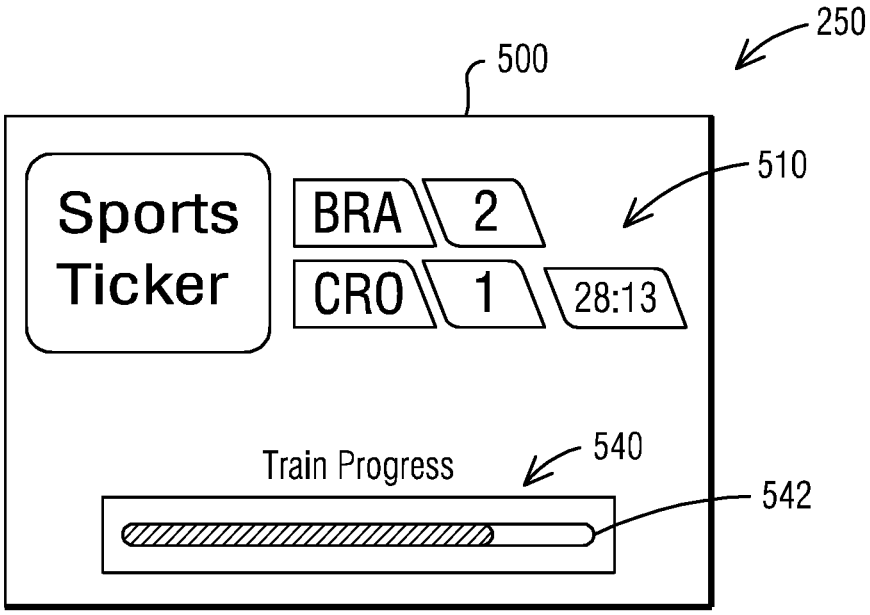
FIG. 5 illustrates a further embodiment of a railroad crossing indication device in accordance with an exemplary embodiment of the present invention.

FIG. 5 illustrates a further embodiment of a railroad crossing indication screen 500 of a railroad crossing indication device 250. The indication screen 500 can comprise two sections 510, 540. Section 540 comprises a progress bar 542 or progress indicator visualizing progression of an approaching train. Section 510 provides space for showing any desired information, as chosen for example by a railroad owner. In FIG. 5, section 510 is used for showing entertainment programs such as for example movies, sports events, news, etc. For example, section 510 can show results of a current soccer game, for example as part of news.

There are many other types of information and/or programs that can be displayed on the indication device 250 while waiting for a train passing through the railroad crossing, such as for example safety tips, train speed, direction of train approach, train proximity, time the train takes to pass the railroad crossing, etc. An attractive option, in particular for railroad owners, is to display advertising/commercials on the indication device 250, for example with reference to FIG. 5 in section 510, while waiting for the approaching train. This option can provide additional revenue for the railroad owners. Programs such as movies and advertising can be loaded and stored in the indication device 250 directly, for example in a memory device integrated in and/or operably coupled to the indication device 250. Other programs such as news and sports events can be broadcasted for example via local television programs using for example a television antenna coupled to the indication device 250. One of ordinary skill in the art can easily conceive many other options how to provide and display information and programs on the indication device 250, for example using the Internet.

During a break until a next train will arrive at the railroad crossing after the present train has passed the crossing, the indication device 250 can be turned off, for example if the break is long, for example one hour or more, and then turned on again before the next train arrives at the crossing, for example simultaneously with when the GCP system 40 detects an approaching train and sends signals to active the warning devices 210, 212, 220, 230 (see FIG. 2). If the break in between consecutive trains is relatively short, for example less than one hour, the indication device 250 can continue to display information as for example illustrated in FIG. 4. It should be noted that the indication device 250 can always be in operation or turned on/off during specific times, as desired for example by the railroad owner.

By using an engaging display to convey important information such as for example train speed, train direction of approach, train proximity, time of arrival of train at the crossing and/or time the train takes to pass the railroad crossing, motorists will be deterred from circumventing installed safety systems. If a motorist has a better understanding of how long a train takes to arrive, how fast or close it is to the grade crossing, or how long until a train passes, they will be further deterred from attempting to circumvent safety systems.

Figure 6:
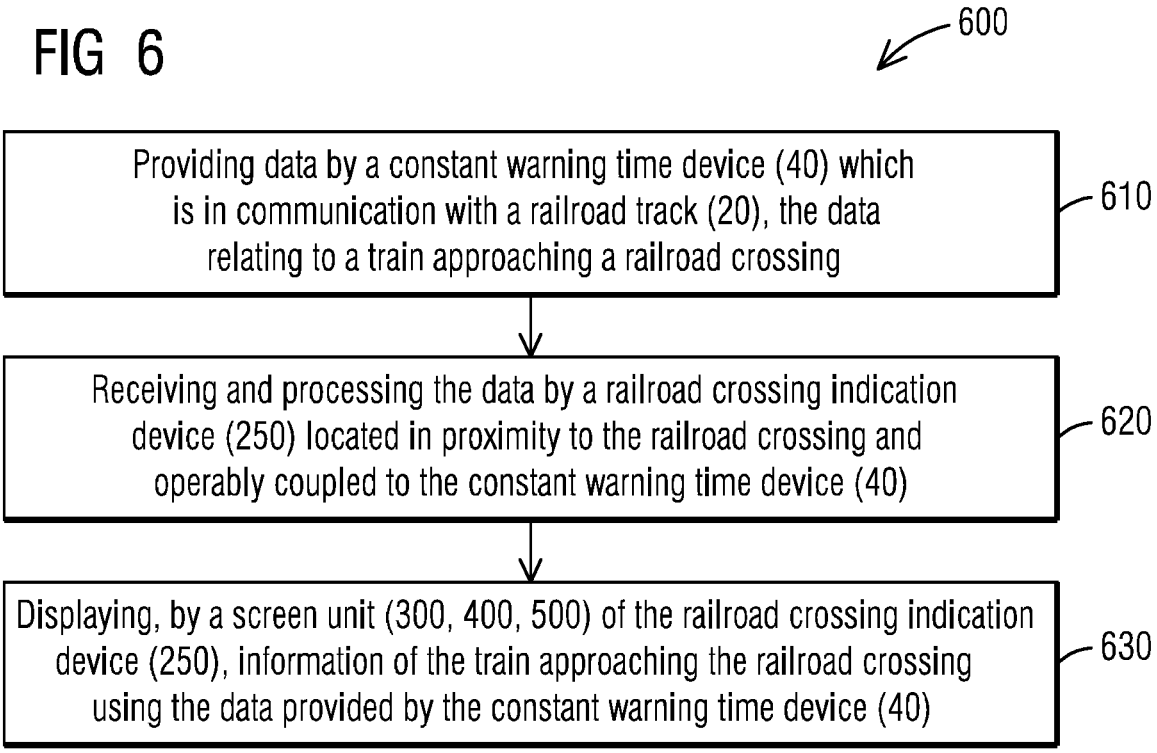
FIG. 6 illustrates a flow chart of a method for displaying information at railroad crossings in accordance with an exemplary embodiment of the present invention.

FIG. 6 illustrates a flow chart of a method 600 for displaying information at railroad crossings in accordance with a railroad crossing indication system 200 and railroad crossing indication device 250 as described herein. In step 610, data is provided by the constant warning time device 40 which is in communication with a railroad track 20 (see for example FIG. 2), wherein the data relate to a train approaching a railroad crossing. According to step 620, the data are received and processed by the railroad crossing indication device 250 (see for example FIG. 3) located in proximity to the railroad crossing and operably coupled to the constant warning time device 40. A screen unit 300, 400, 500 of the railroad crossing indication device 250 (see for example FIG. 3) displays corresponding information of the train approaching the railroad crossing using the data provided by the constant warning time device 40 (step 630).

The described railroad crossing indication device and system allow railroad owners to equip new railroad crossings or to retrofit existing crossings with more accurate and safer warnings to motorists via a real time display. The concept can be integrated into future and currently deployed railroad crossings, in particular railroad crossings comprising a GCP system, because information which is already being provided by the GCP system is used to display relevant safety, warning, and convenience information. The disclosed device and system will further provide a convenience for motorists by indicating how soon the train will pass. Both will lead to a reduction in the ignoring of safety warnings by abating motorist impatience.

While embodiments of the present invention have been disclosed in exemplary forms, it will be apparent to those skilled in the art that many modifications, additions, and deletions can be made therein without departing from the spirit and scope of the invention and its equivalents, as set forth in the following claims.

The invention claimed is:

1. Railroad crossing indication device comprising:

a processing unit configured to receive and process data provided by a constant warning time device in communication with a railroad track, wherein the data relate to a train approaching the railroad crossing; and a screen unit configured to display information of the train approaching the railroad crossing based upon the data provided by the constant warning time device, and a memory unit storing a plurality of graphical elements including progress bars, wherein the screen unit comprises multiple screen sections, a first section of the multiple screen sections displaying a progress bar visualizing progression of the train approaching the railroad crossing, wherein the processing unit is configured to select the progress bar from the plurality of graphical elements.

2. The railroad crossing indication device as in claim 1, wherein the information of the train approaching the railroad crossing is selected from a group consisting of train speed, direction of train, proximity of train, time of arrival of train at the railroad crossing, time a train takes to pass a railroad crossing, and a combination thereof.

3. The railroad crossing indication device as in claim 1, wherein the railroad crossing indication device is located in proximity to the railroad crossing mounted to a support assembly of an existing railroad crossing warning device.

4. A railroad crossing indication system comprising:

a constant warning time device in communication with a railroad track;

at least one railroad crossing warning device located at a railroad crossing in communication with the constant warning time device; and a railroad crossing indication device located in proximity to the railroad crossing and the at least one railroad crossing warning device, and in communication with the constant warning time device, wherein the railroad crossing indication device displays information relating to a train approaching the railroad crossing based upon data of the train approaching the railroad crossing provided by the constant warning time device, wherein the railroad crossing indication device comprises a screen unit displaying the information relating to the train approaching the railroad crossing, and a memory unit storing a plurality of graphical elements including progress bars, wherein the screen unit comprises multiple screen sections, a first section of the multiple screen sections displaying a progress bar visualizing progression of the train approaching the railroad crossing, wherein the processing unit configured to select the progress bar from the plurality of graphical elements.

5. The railroad crossing indication system as in claim 4, wherein the constant warning time device is a grade crossing predictor (GCP) operably coupled to a processing unit of the railroad crossing indication device by connecting elements.

6. The railroad crossing indication system as in claim 4, wherein the railroad crossing indication device is mounted to a support assembly of the at least one railroad crossing warning device.

7. The railroad crossing indication system as in claim 4, wherein the information of the train approaching the railroad crossing is selected from a group consisting of train speed, direction of train, proximity of train, time of arrival of train at the railroad crossing, time the train takes to pass the railroad crossing, and a combination thereof.

8. The railroad crossing indication system as in claim 4, the railroad crossing indication device further comprising:

a processing unit configured to receive and process data provided by the constant warning time device, wherein the data relate to the train approaching the railroad crossing.

9. A method for displaying information at a railroad crossing comprising:

providing data by a constant warning time device which is in communication with a railroad track, the data relating to a train approaching a railroad crossing;

receiving and processing the data by a processing unit a railroad crossing indication device located in proximity to the railroad crossing and operably coupled to the constant warning time device; and displaying, by a screen unit of the railroad crossing indication device, information of the train approaching the railroad crossing using the data provided by the constant warning time device, wherein the screen unit comprises multiple screen sections, a first section of the multiple screen sections displaying a progress bar visualizing progression of the train approaching the railroad crossing, wherein the processing unit is configured to select the progress bar from a plurality of graphical elements stored in a memory unit of the railroad crossing indication device.

10. The method as in claim 9, wherein the information of the train approaching the railroad crossing is selected from a group consisting of train speed, direction of train, proximity of train, time of arrival of train at the railroad crossing, time the train takes to pass the railroad crossing, and a combination thereof.

11. The method as in claim 10, wherein the additional information comprises advertisement, news, movies, weather conditions, time information, and a combination thereof.

* * * * *